US012140348B2

(12) United States Patent
Richards

(10) Patent No.: US 12,140,348 B2
(45) Date of Patent: Nov. 12, 2024

(54) REFRIGERATION EVAPORATORS AND SYSTEMS

(71) Applicant: ALGESACOOLING PTY LTD, Red Hill (AU)

(72) Inventor: Alan Richards, Capalaba (AU)

(73) Assignee: ALGESACOOLING PTY LTD., Capalaba Qld (AU)

( * ) Notice: Subject to any disclaimer, the term of this patent is extended or adjusted under 35 U.S.C. 154(b) by 328 days.

(21) Appl. No.: 17/555,179

(22) Filed: Dec. 17, 2021

(65) Prior Publication Data

US 2022/0113070 A1 Apr. 14, 2022

Related U.S. Application Data

(63) Continuation-in-part of application No. PCT/AU2020/050590, filed on Jun. 11, 2020.

(51) Int. Cl.
*F25B 39/02* (2006.01)
*F25B 13/00* (2006.01)

(52) U.S. Cl.
CPC ..... *F25B 39/02* (2013.01); *F25B 13/00* (2013.01)

(58) Field of Classification Search
CPC ..... F28F 9/26; F28F 3/12; F28F 3/14; F28F 2210/02; F28F 2210/10; F25B 39/02; F25B 13/00; F25B 39/00; F25B 39/022; F25B 41/00; F25B 1/06; F25B 2339/02; F25B 2339/04; F28D 9/00; F28D 2021/0071; F28D 2021/0084; F28D 2021/0085; F28D 9/0043; F28D 9/0075
See application file for complete search history.

(56) References Cited

U.S. PATENT DOCUMENTS 3,251,397 A 5/1966 Lens
3,789,583 A 2/1974 Smith
2014/0331701 A1 11/2014 James
(Continued)

FOREIGN PATENT DOCUMENTS

WO WO2015038983 A2 3/2015
WO WO2016187601 A2 11/2016

*Primary Examiner* — Henry T Crenshaw
*Assistant Examiner* — Kamran Tavakoldavani
(74) *Attorney, Agent, or Firm* — David W. Carstens; Jorge Miguel Hernandez; Carstens, Allen & Gourley, LLP

(57) ABSTRACT

A refrigeration evaporator comprising fluidly connected liquid chambers disposed between first and second layers of material, and an inlet for receiving and introducing liquid refrigerant into one of the liquid chambers. Each of the chambers are interconnected by respective overflow inlets and outlets to allow flow of liquid refrigerant between the connected chambers under gravity such that, during influent flow of the liquid through the inlet, the chambers accumulate the liquid sequentially to impede the flow. The evaporator further comprises vapor circuit including respective draw off vapor channels for receiving flow of refrigerant vapor from corresponding chambers. The vapor channels are in fluid communication with peripheral vapor channels disposed along peripheral regions of the evaporator for reducing or preventing slugs of liquid refrigerant flowing into the circuit. The circuit and the overflow inlets and outlets are disposed between the first and second layers of material.

18 Claims, 10 Drawing Sheets

(56) References Cited

U.S. PATENT DOCUMENTS

| | | | | |
|---|---|---|---|---|
| 2016/0153317 | A1* | 6/2016 | Geskes | F28F 3/005 62/515 |
| 2016/0290730 | A1* | 10/2016 | Taras | F28F 1/126 |
| 2016/0327317 | A1* | 11/2016 | Inoue | F28D 1/0471 |
| 2017/0334737 | A1 | 11/2017 | Govindan et al. | |
| 2018/0094831 | A1 | 4/2018 | Hertgers | |

* cited by examiner

REFRIGERATION EVAPORATORS AND SYSTEMS

CROSS-REFERENCE TO RELATED APPLICATIONS

This application is a Continuation-in-Part of PCT Application No. PCT/AU2020/050590 filed on Jun. 11, 2020, which claims priority benefits of Australian Application No. 2019902148 filed Jun. 20, 2019. The technical disclosures of the applications are hereby incorporated herein by reference.

TECHNICAL FIELD

The present invention relates to refrigeration evaporators and systems in which potentially undesirable interactions between liquid phase and vapour phase refrigerants are alleviated or mitigated.

BACKGROUND

Any references to methods, apparatus or documents of the prior art are not to be taken as constituting any evidence or admission that they formed, or form part of the common general knowledge.

The cost of mains power has historically been relatively inexpensive. However, it is anticipated that as we move to reduce our reliance on fossils fuels and increase the use of renewable energy, the cost of electricity may continue to increase. The increasing costs of electricity has motivated consumers to reduce their energy costs by installing solar and other 'off grid' systems, many of which have a prohibitive initial setup cost, for example, in the provision of solar arrays and expensive battery banks. In residential and commercial settings, refrigeration often results in a significant load requirement. Currently there many different refrigeration system designs in the market aimed at reducing power consumption to meet the energy compliance requirements of some countries.

Portable or mobile refrigeration systems have generally been designed based on scaling down of existing domestic and industrial designs. The existing portable systems generally rely on batteries to provide stored energy for consumption. It is anticipated that in the case of portable or solar based systems, reducing electricity consumption may provide significant benefits.

Existing Refrigeration System Design Inefficiencies

Start up zone—Each time the compressor in existing systems is powered ON it takes time for the system to stabilise and provide liquid refrigerant into the evaporator. During this time the compressor is consuming power and not providing efficient cooling. The higher the cycle rate, that is, the higher the rate of cycling from ON to OFF per hour/day to maintain storage compartment temperature, the more time the compressor consumes power inefficiently.

Existing systems use a high cycle rate to maintain compartment temperatures, especially in high ambient conditions. This is required due to an inability to hold compartment temperatures stable for any length of time.

An example of the duty cycle of an existing refrigeration system is provided in FIG. 1.

Lead acid batteries—When DC compressors startup they use a higher current until the system stabilises. The higher current load will reduce the available energy from a lead acid battery. Lead acid batteries have internal losses that increase with load current.

Thermal heat transfer—Thermal heat transfer relies on thermal transfer from the cooling (evaporator) plate to the air inside the refrigerator storage compartment. Transferring heat energy from air to the evaporator is inherently inefficient and requires a large surface with a low temperature on the plate to create the necessary temperature difference (TD) between the evaporator plate and the air to maintain the storage compartment temperature. Often the TD between the evaporator and storage compartment temperature is 10-15 C. The compressor can only be operated for a short time at that TD otherwise the product nearest the evaporator will start to have a lower storage temperature than is desired. This can result in the product freezing when it is only suitable for fridge temperature storage.

Due to this thermal heat transfer it is difficult to maintain a consistent temperature in all areas of the storage compartment. To overcome this, some systems use a fan which has the benefit of reducing TD between the evaporator and the storage compartment. This may also help to provide a uniform temperature throughout the storage compartment.

Cabinet hold time—Storage compartment temperatures in conventional systems can only hold for a short duration without the system operating. The holding time is generally dependent on the size of the storage compartment, density, thickness and thermal conductivity of the insulation and the TD between the inside compartment temperature and the outside atmospheric temperature.

Portable refrigeration systems are often used in applications where size and weight are important factors. This puts constraints on the thickness and density of the insulation. The market is also very cost sensitive and therefore keeping the price low is also an important factor in product design versus cabinet efficiency.

Due to these factors the running time per day can be as high as 25-100%.

Noise and heat—In many instances portable and mobile refrigeration systems are installed in close proximity to a sleeping area. The compressor will generally generate a significant amount of heat and noise during the ON cycle, with fans cycling during the night. This is detrimental to overnight operation so far as user convenience is concerned.

Existing System Evaporator Design Inefficiencies

In conventional evaporator systems, it is considered that reduced efficiencies are often experienced due to the flow of liquid and vapour through the evaporator. Generally, the liquid flows to the lowest point and collects in an accumulator. An example of such a conventional system and its start-up operation is illustrated in FIG. 2. Some general comments on existing evaporator systems are provided below.

Many systems feed the liquid into the bottom of the evaporator and then use the expanding vapour and suction from the compressor to move slugs of liquid through the combined path to the top of the evaporator. This results in more liquid collecting in the bottom section of the evaporator, hence reducing the effective thermal transfer area and creating colder temperatures in the bottom section of the compartment.

One path—Existing evaporators have one combined liquid and vapour path through the evaporator.

Vapour and liquid thermal transfer—Compared to liquid, heat transfer through vapour is significantly less efficient. As the amount of vapour increases in the evaporator the less heat load that can be absorbed.

Liquid slugs—As the liquid is injected into the evaporator plate a portion of the liquid boils off to vapour. This vapour then expands and displaces the liquid in contact with the metal surface of the evaporator plate. The suction pressure from the compressor draws the vapour towards the compressor and this in turn draws slugs of liquid with it as it moves through the evaporator. The last section of the evaporator plate may be designed to be an accumulator to trap the liquid and prevent it reaching and damaging the compressor.

Accumulator liquid concentration and ice build-up—The liquid accumulates primarily in the accumulator or one section of the evaporator plate resulting in inconsistent ice build-up, mostly around this section. Ice is an insulator and therefore reduces the thermal heat load to the liquid. The end result is a lower suction pressure/temperature required to enable thermal heat transfer through the ice layer. The thicker the ice layer the greater the TD between the liquid and the storage compartment and the lower the system efficiency.

Large evaporators—Large evaporator plates are generally required due to the inefficient thermal transfer from the storage compartment air to the plate. Often the evaporator plate constitutes a complete inner liner to the cabinet and is bonded to the insulation. This reduces production cost but also reduces the system performance (efficiency). This is evident when the inside storage compartment temperature is reduced and/or outside ambient temperature increased. The TD of the evaporator plate to storage compartment air temperature is typically about 10-15° C. This results in the evaporator temperature being −10 to −15° C. The lower the evaporator temperature the lower the COP (coefficient of performance) achieved. Generally the COP of refrigerators is about 1.

Liquid traps—To increase liquid transfer, existing designs trap liquid along the path through the evaporator plate. Often a small bypass section is added to trap the liquid. This has minimal effect due to the liquid flowing to the lowest points, and liquid that is boiling off creating sections of trapped vapour that push the liquid along the tubing out of the liquid trap. In practice, the top section of the trap is often filled with vapour. The rapid expansion of the liquid as it boils off to vapour easily displaces the liquid around it, pushing it out of the liquid traps.

Liquid volume in the system—One solution is to increase the liquid volume in the evaporator by increasing the refrigerant charge. This generally results in improved evaporator performance, but will also cause liquid flood back to the compressor at different ambient temperature conditions. Managing this can require additional accumulators or mechanical and/or electronic controls which increase the manufacturing cost of the system. Additional accumulators and/or increased refrigerant charge may also increase thermal inefficiencies of the system and limit the compressor's ability to draw off the vapour at a sufficient rate to lower and maintain the required evaporator temperature/pressure for constant storage compartment conditions at different ambient temperatures.

Consistent storage compartment temperatures and gradients—Maintaining consistent temperatures throughout the storage compartment/s in a refrigeration system is always a challenge. Portable refrigerators, due to their design, generally have poor performance in maintaining constant temperatures in all areas of the storage compartment. Typically, the static evaporator surface area is large so as to provide thermal heat transfer to a large part of the storage compartment and hence are installed in close proximity to the products being stored. The evaporators operate at a large TD due to their inefficient thermal design, often resulting in product being too cold or frozen when located close to the evaporator plate and not cold enough in the middle and upper areas of the storage compartment. Many models incorporate a basket to hold the product away from direct contact with the evaporator plate. The basket also assists with air flow around the product and provides an easy solution for the consumer to remove the contents for restocking or cleaning. The existing designs usually have a high duty cycle to assist with maintaining stable storage compartment temperatures.

Dual cabinet refrigerators—Some products provide a dual compartment cabinet which allows the customer to store products at fridge (fresh food) temperatures in one section and freezer temperatures in a different section. The use of one evaporator to achieve this often results in poor performance of the system, particularly with regard to the fridge cabinet temperature and extra power usage. Typically, the most common and simplest method of temperature control involves using the evaporator plate temperature to control the duty cycle. In a dual cabinet system, the evaporator is located in the freezer compartment.

SUMMARY OF INVENTION

In an aspect, the invention provides a refrigeration evaporator for use in refrigeration systems, the evaporator comprising:

- a plurality of fluidly connected liquid chambers disposed between first and second layers of material,
- an inlet for receiving and introducing liquid refrigerant into at least one of said plurality of liquid chambers; and wherein each of the liquid chambers are interconnected by respective overflow inlets and outlets to allow flow of liquid refrigerant between the plurality of fluidly connected liquid chambers under gravity such during influent flow of the refrigerant liquid through the inlet, the liquid chambers accumulate the refrigerant liquid sequentially to impede the flow of the refrigerant liquid;
- a vapour circuit comprising respective draw off vapour channels being provided to receive flow of refrigerant vapour from corresponding liquid chambers, the draw off vapour channels being in fluid communication with peripheral vapour channels disposed along peripheral regions of the evaporator for reducing or preventing slugs of liquid refrigerant flowing into the vapour circuit
- wherein the vapour circuit and the overflow inlets and outlets are disposed between the first and second layers of material.

In an embodiment, each respective vapour channel is located along an in-use upper portion of the corresponding liquid chamber.

In an embodiment, the overflow inlets for each liquid chamber is fluidly connected with respective overflow channels disposed along peripheral regions of corresponding liquid chambers and wherein the vapour channels are disposed radially outwardly relative to the overflow channels.

In an embodiment, each liquid chamber comprises a bottom wall, a top wall and side walls such that inner surfaces of the bottom wall, top wall and side walls define a substantially enclosed internal volume for accumulating the liquid refrigerant such and wherein outer surfaces of one or more of the top wall, side wall and bottom wall define at least a portion of the overflow channels.

In an embodiment, the overflow outlet for each liquid chamber is located to direct the overflow of the liquid refrigerant along the outer surface of the top wall of said each liquid chamber defining a portion of the overflow channel to spread the overflowing liquid along the outer surface of the top wall and facilitate vapour draw off from the overflow channel into the peripherally disposed vapour channels.

In an embodiment, each liquid chamber is surrounded by an outer peripheral walls such that an inner surface of the outer peripheral walls define a portion of the overflow channel and an outer surface of the peripheral walls defines a portion of the vapour channels.

In an embodiment, in an in-use configuration, each of the liquid chambers are positioned at different relative heights to allow flow of liquid refrigerant between the plurality of fluidly connected liquid chambers under gravity.

In an embodiment, the refrigeration evaporator further comprises a vapour outlet being fluidly coupled with the vapour circuit to allow coupling of a compressor with the vapour circuit for allowing the compressor, when fluidly connected to the vapour outlet, to receive and compress vapour under high pressure during use.

In an embodiment, the vapour circuit and the overflow inlets and outlets are disposed between the first and second layers of roll bonded metal.

In another aspect, the invention provides a refrigeration system comprising:

a refrigeration evaporator as described herein, a compressor being fluidly coupled to the vapour circuit of the evaporator for receiving and compressing vapour under high pressure; and a condenser in fluid communication with the compressor for receiving compressed vapour from the compressor and condensing the compressed vapour to form liquid refrigerant and fluidly coupling the condenser to pass the liquid refrigerant to the liquid inlet.

In another aspect, the invention provides a refrigeration evaporator for use in refrigeration systems, the evaporator comprising:

a plurality of fluidly connected liquid chambers, an inlet for receiving and introducing liquid refrigerant into at least one of said plurality of liquid chambers; and wherein each of the liquid chambers are interconnected by respective overflow inlets and outlets to allow flow of liquid refrigerant between the plurality of fluidly connected liquid chambers under gravity such that during influent flow of the refrigerant liquid through the inlet, the liquid chambers accumulate the refrigerant liquid sequentially to impede the flow of the refrigerant liquid;

a vapour circuit comprising vapour conduits comprising respective draw off vapour channels being provided to receive flow of refrigerant vapour from corresponding liquid chambers, the draw off vapour channels being in fluid communication with peripheral vapour channels disposed along peripheral regions of the evaporator for reducing or preventing slugs of liquid refrigerant flowing into the vapour circuit.

In an embodiment, each respective vapour channel is located along an in-use upper portion of the corresponding liquid chamber.

In an embodiment, the overflow inlets for each liquid chamber is fluidly connected with respective overflow channels disposed along peripheral regions of corresponding liquid chambers and wherein the vapour channels are disposed radially outwardly relative to the overflow channels.

In an embodiment, each liquid chamber comprises a bottom wall, a top wall and side walls such that inner surfaces of the bottom wall, top wall and side walls define a substantially enclosed internal volume for accumulating the liquid refrigerant such and wherein outer surfaces of one or more of the top wall, side wall and bottom wall define at least a portion of the overflow channels.

In an embodiment, the overflow outlet for each liquid chamber is located to direct the overflow of the liquid refrigerant along the a stepped portion of each liquid chamber, the stepped portion defining a portion of the overflow channel to spread the overflowing liquid along the outer surface of the stepped portion and facilitate vapour draw off from the overflow channel into the peripherally disposed vapour channels.

In an embodiment, each liquid chamber is surround by outer peripheral walls such that an inner surface of the outer peripheral walls define a portion of the overflow channel and an outer surface of the peripheral walls defines a portion of the vapour channels.

In an embodiment, in an in-use configuration, each of the liquid chambers are positioned at different relative heights to allow flow of liquid refrigerant between the plurality of fluidly connected liquid chambers under gravity.

In an embodiment, the refrigeration evaporator further comprises a vapour outlet being fluidly coupled with the vapour circuit to allow coupling of a compressor with the vapour circuit for allowing the compressor, when fluidly connected to the vapour outlet, to receive and compress vapour under high pressure during use.

In an embodiment, the refrigeration evaporator further comprises a plurality of fins associated with plurality of conduits forming the vapour circuit.

In another aspect, the invention provides a refrigeration system comprising:

a refrigeration evaporator as described herein, a compressor being fluidly coupled to the vapour circuit of the evaporator for receiving and compressing vapour under high pressure; and a condenser in fluid communication with the compressor for receiving compressed vapour from the compressor and condensing the compressed vapour to form liquid refrigerant and fluidly coupling the condenser to pass the liquid refrigerant to the liquid inlet.

In yet another aspect, there is provided a refrigeration evaporator for use in refrigeration systems, the evaporator comprising:

a plurality of fluidly connected liquid chambers;

an inlet for receiving and introducing liquid refrigerant into one of said plurality of liquid chambers; and wherein each of the liquid chambers are interconnected by overflow channels to allow flow of liquid refrigerant between the plurality of fluidly connected liquid chambers under gravity such during influent flow of the refrigerant liquid the liquid chambers accumulate the refrigerant liquid sequentially to impede the flow of the refrigerant liquid;

a vapour circuit being provided to receive flow of refrigerant vapour from corresponding liquid chambers, the vapour circuit comprising vapour flow paths disposed within the overflow channels wherein each overflow channel comprises a sufficiently large cross-section to facilitate flow of vapour along the vapour flow paths therein to allow the liquid to collect and flow without the vapour pushing slugs of the liquid through the cross-section without blocking the flow of the liquid.

In an embodiment, vapour flow paths are located along in-use upper portions of an internal volume of the liquid chambers.

In an embodiment, the overflow inlets for each liquid chamber is fluidly connected with respective overflow channels disposed along peripheral regions of corresponding liquid chambers and wherein the vapour flow paths are disposed within the overflow channels.

In an embodiment, each liquid chamber comprises a bottom wall, a top wall and side walls such that inner surfaces of the bottom wall, top wall and side walls define a substantially enclosed internal volume for accumulating the liquid refrigerant and wherein the overflow outlet for one or more liquid chambers comprises a stepped portion along a side wall that is sufficiently spaced away from the top wall to allow to facilitate flow of vapour along the vapour flow paths in an upper portion of the liquid chamber, the upper portion being at or adjacent the top wall of the liquid chamber for reducing interaction between the vapour and the liquid refrigerant during use.

In an embodiment, the stepped portion defines a portion of the overflow channel to spread the overflowing liquid along the outer surface of the stepped portion and facilitate vapour draw off from the overflow channel into the peripherally disposed vapour channels.

In an embodiment, each liquid chamber is surrounded by outer peripheral walls such that an inner surface of the outer peripheral walls defines a portion of the overflow channels.

In an embodiment, in an in-use configuration, each of the liquid chambers are positioned at different relative heights to allow flow of liquid refrigerant between the plurality of fluidly connected liquid chambers under gravity.

In an embodiment, the refrigeration evaporator further comprises a vapour outlet being fluidly coupled with the vapour circuit to allow coupling of a compressor with the vapour circuit for allowing the compressor, when fluidly connected to the vapour outlet, to receive and compress vapour under high pressure during use.

In an embodiment, influent flow rate of the liquid refrigerant through the fluidly connected chambers is controlled by a controller.

In another aspect, the invention provides a refrigeration evaporator for use in refrigeration systems, the evaporator comprising:

- a plurality of separate liquid chambers disposed between first and second layers of material,
  - a respective inlet for receiving and introducing liquid phase refrigerant into a corresponding liquid chamber, each respective inlet being positioned along a portion of the corresponding liquid chamber for allowing the liquid to flow into a bottom part of the liquid chamber under gravity;
  - a vapour circuit comprising respective draw off vapour channels being provided along an upper part of respective liquid chambers to receive flow of refrigerant vapour from corresponding liquid chambers, the draw off vapour channels being provided for reducing or preventing slugs of liquid refrigerant flowing into the vapour circuit.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Hereinafter, this specification will describe the present invention according to the preferred embodiments. It is to be understood that limiting the description to the preferred embodiments of the invention is merely to facilitate discussion of the present invention and it is envisioned without departing from the scope of the appended claims.

Figure 1:
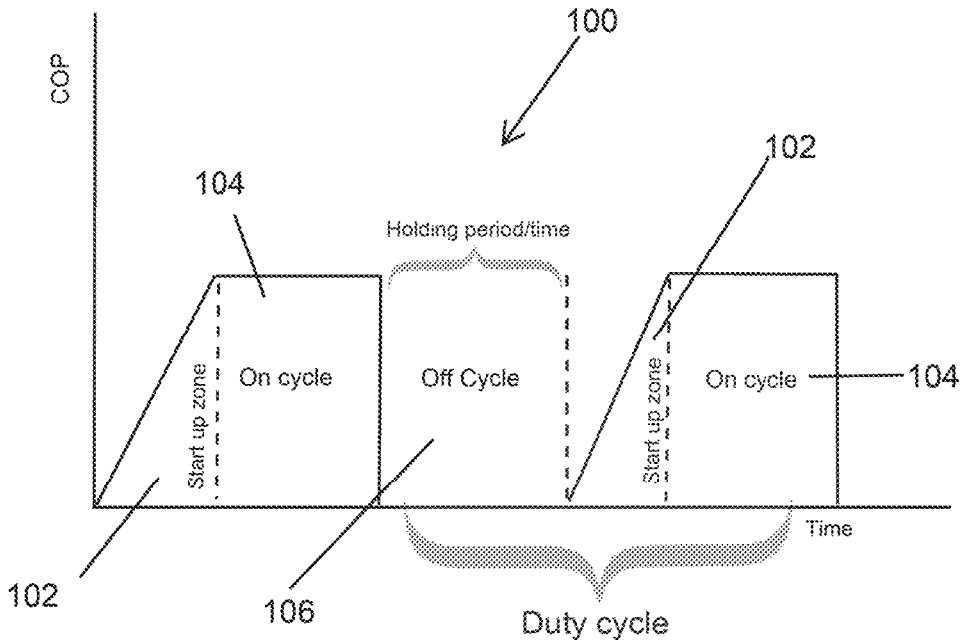
FIG. 1 illustrates an example of the duty cycle of a conventional refrigeration system.

Referring to FIG. 1, as previously noted, existing systems use a high cycle rate to maintain compartment temperatures, especially in high ambient conditions. This is required due to an inability to hold compartment temperatures stable for any length of time as shown in FIG. 1, which illustrates the cycle 100 graphically. Generally, this involves start-up zones 102, in which the system is compressing sufficient vapour into the condenser at a high enough pressure to enable condensing of vapour into liquid. Once the desired operating pressures and temperatures are reached the system is maintained with an ON cycle 104. This enables an OFF cycle 106, during which time the system is shut down, while maintaining an acceptable temperature within the cabinet. It will be appreciated that if left in this mode, the cabinet would soon reach an unacceptable internal temperature, the speed depending on the ambient external temperature, amongst other factors. As such, before reaching an unacceptable storage temperature the system again runs a start-up 102 and an ON cycle 104.

Figure 2:
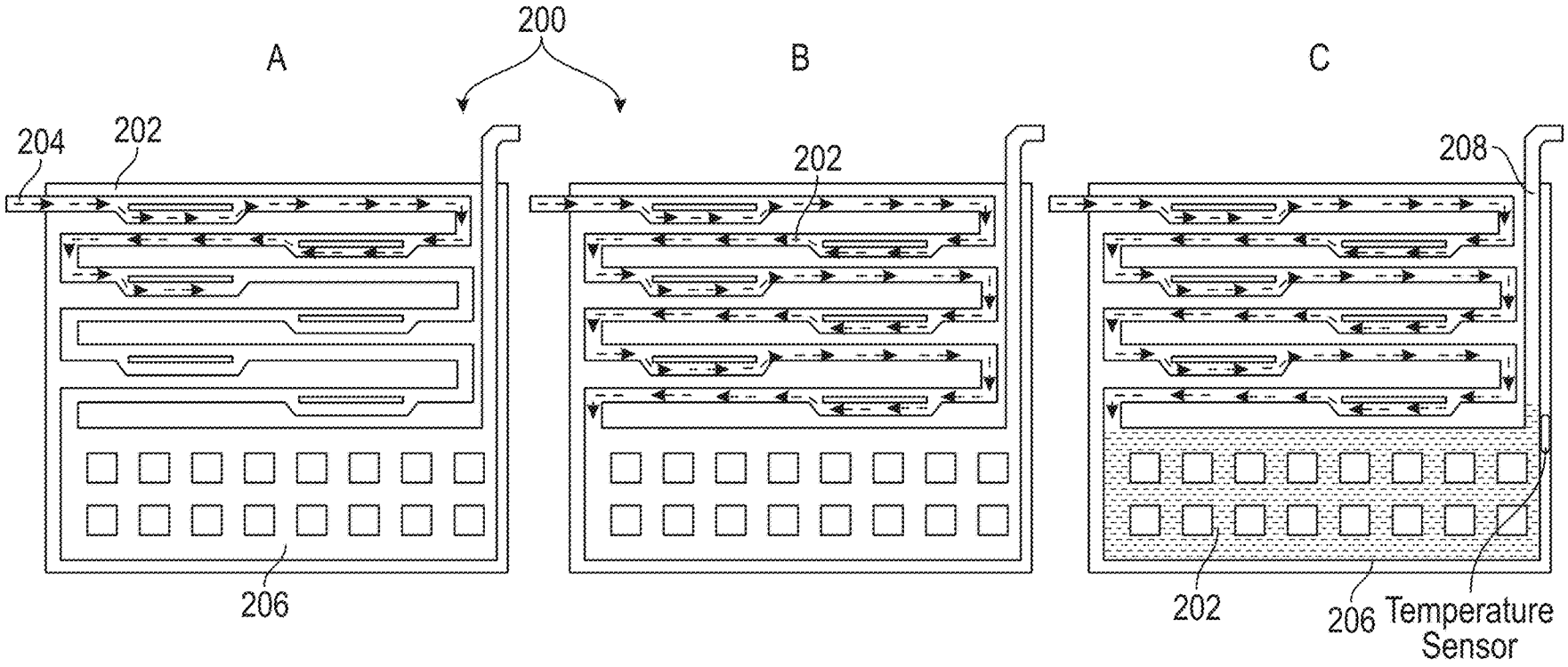
FIG. 2 illustrates a start-up procedure using a conventional evaporator plate.

With reference to FIG. 2, a start-up procedure using a conventional evaporator plate 200 is illustrated. When the system starts up as illustrated in stage A, liquid 202 enters through a liquid inlet 204 and trickles into the evaporator plate 200. Due to the thermal load stored in the evaporator plate 200 during the off cycle, most of the liquid 202 immediately boils off before reaching the accumulator 206 (bottom section of the evaporator plate 200).

In stage B as more liquid 202 flows into the evaporator plate 200, the liquid 202 starts to accumulate as there is more than can be boiled off through thermal conduction from the air. This liquid 202 then progressively makes it further through the evaporator plate 200.

In stage C the liquid 202 starts to fill the accumulator 206, and suction pressure continues to drop maintaining the thermal load from the air. However, as the suction pressure drops so does the COP. As the cabinet temperature gets close to the evaporating temperatures the suction pressure continues to drop as the thermal load "rolls off". As the load continues to drop off the liquid 202 builds up in the accumulator 206 and eventually overflows to a liquid overflow. This liquid overflow 208 triggers a thermostat sensor to shut off the compressor to prevent flood back.

As the liquid 202 pools in the accumulator 206 at the bottom of the evaporator plate 200 it reduces the effective thermal transfer area of the evaporator plate 200. The liquid 202 continues to build up in the accumulator 206 until it forms a liquid seal over the suction line 208 through which vapour exits the evaporator plate 200. The vapour in the top of the evaporator plate 200 pushes on the accumulated liquid while the suction from the compressor pulls on the liquid that has sealed the suction line 208. This can cause flood back of liquid into the compressor. There is no way for the vapour to be drawn out of the evaporator plate 200 once the accumulator 206 is flooded with liquid Adding more gas to the system will increase performance as it maintains a higher evaporator temperature. However, this also increases the build-up of liquid 202 in the accumulator 206. Due to the potential for flood back to damage the compressor the thermostat shuts off the system before the cabinet has reached the required temperature.

Figure 3:
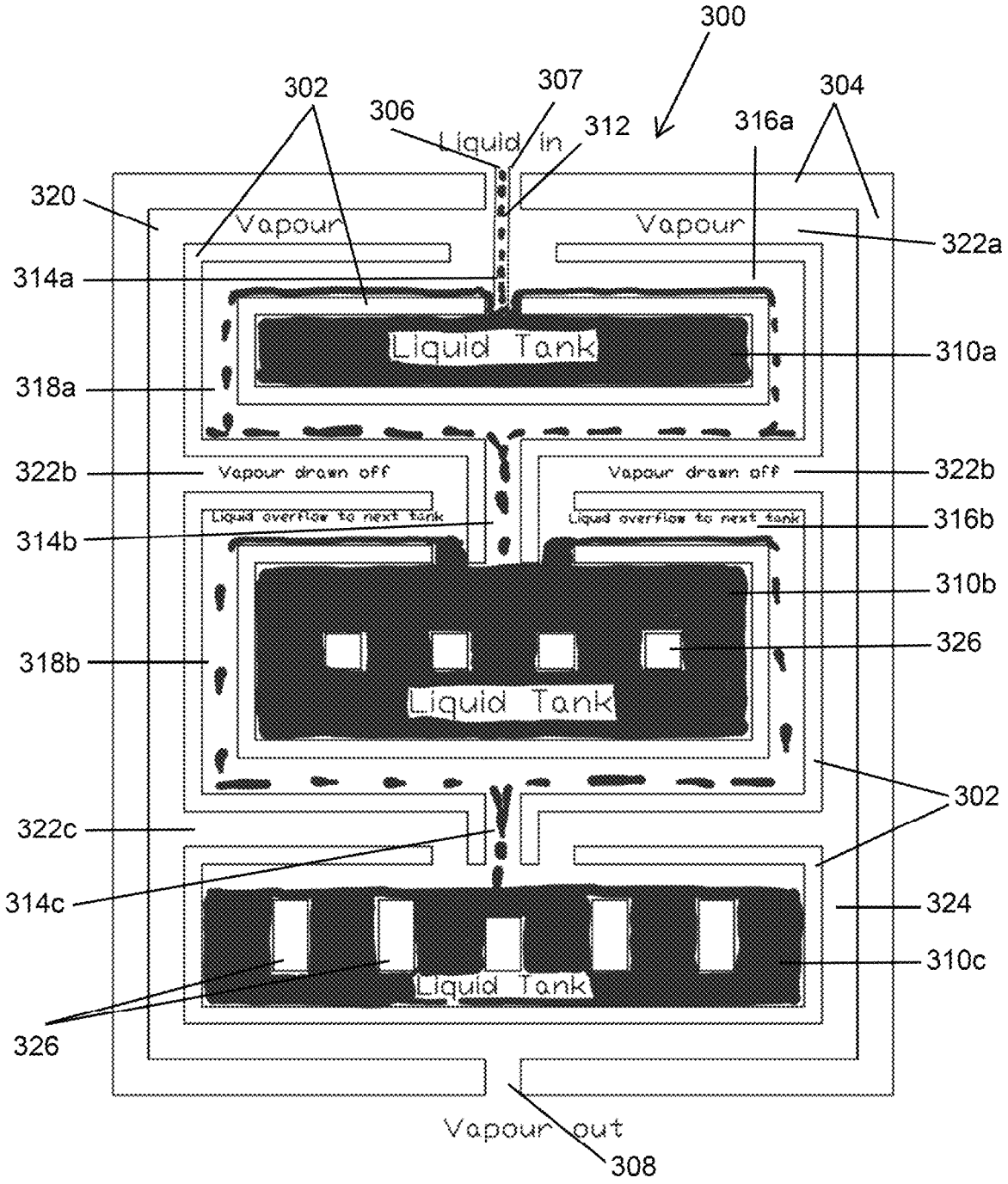
FIG. 3 illustrates a cut-away view of a thermal transfer device according to one embodiment of the invention.
Figure 4:
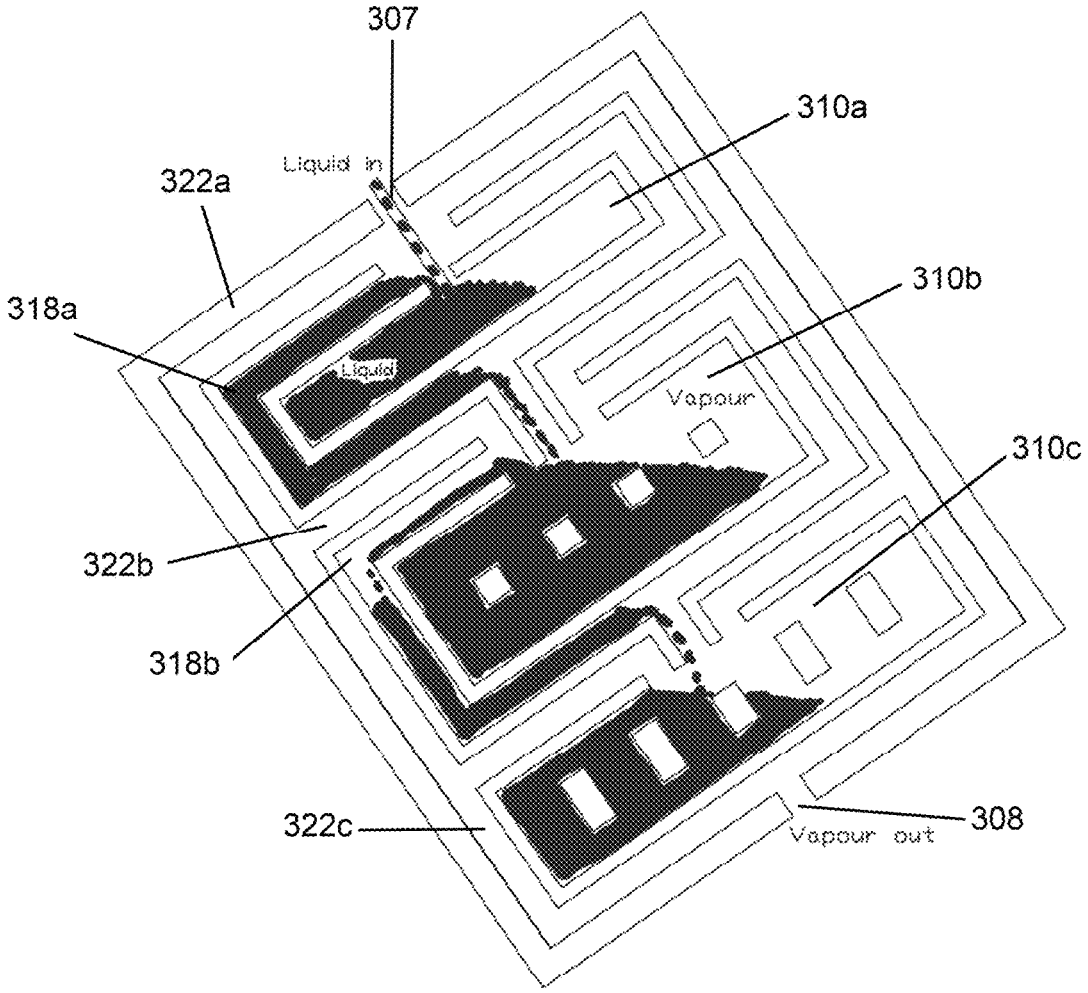
FIG. 4 illustrates the cut-away view of the thermal transfer device of FIG. 3 disposed on an angle.

Referring to FIGS. 3 and 4, a thermal transfer device of an embodiment of the invention is illustrated. In this instance, the thermal transfer device is a refrigeration evaporator 300. Though not apparent from the cut-away illustration, the evaporator 300 is formed from a first layer of metal and an opposing second layer of metal that are roll bonded together. Roll bonding involves applying pressure to the metal sheets that is sufficient to bond them together. In the case of an evaporator, the metal sheets include treated areas (e.g. painted areas) that define the fluid and vapour path within the evaporator and which do not bond to one another. After the roll bonding process, the un-bonded portions can be inflated, during which the applied coating evaporates. This leaves voids between the bonded metal sheets that, as mentioned above, define the fluid and vapour paths and areas within the evaporator. In this embodiment, walls 302 are defined within the evaporator 300. The walls are formed in areas where the first layer and second layer are bonded to one another. The walls 302 also define paths within which liquid and vapour within the system may travel. Outer edges 304 of the evaporator 300 are also areas at which the first layer and second layer are bonded to one another, other than at a liquid inlet 306 and a vapour outlet 308.

Unlike previous designs in which liquid passes through a meandering channel including a number of spaced liquid traps to ultimately end up in an accumulator, as illustrated in FIG. 2, the evaporator 300 includes a plurality of fluidly connected liquid chambers disposed between the first layer and the opposing second layer of the evaporator 300. In this instance, three liquid chambers 310*a*, 310*b* and 310*c* are included in the evaporator 300.

The first liquid chamber 310*a* receives liquid 312 entering the evaporator 300 via the liquid inlet 306 which is disposed above a first liquid chamber inlet 314*a*. The liquid inlet 306 includes a capillary 307 that extends into the first liquid chamber 310*a*. When the first liquid chamber 310*a* is full, liquid 312 flows out of the first liquid chamber inlet 314*a* into a first liquid overflow 316*a*. The overflowing liquid travels along the first liquid overflow 316*a* into a first overflow channel 318*a* disposed around the peripheral walls of the first liquid chamber 310*a*.

The overflowing liquid then enters the second liquid chamber 310*b* via a second liquid chamber inlet 314*b*. When the second liquid chamber 310*b* is full, liquid 312 flows out of the second liquid chamber inlet 314*b* into a second liquid overflow 316*b*. The overflowing liquid travels along the second liquid overflow 316*b* into a second overflow channel 318*b* disposed around the peripheral walls of the second liquid chamber 310*b*.

The overflowing liquid then enters the third liquid chamber 310*c* via a third liquid chamber inlet 314*c*. Therefore, each of the liquid chambers 314*a*, 314*b* and 314*c* are interconnected by respective overflow inlets and outlets to allow flow of liquid refrigerant between the plurality of fluidly connected liquid chambers under gravity such that during influent flow of the refrigerant liquid through the inlet, the liquid chambers 314*a*, 314*b* and 314*c* accumulate the refrigerant liquid sequentially to impede the flow of the refrigerant liquid.

In conventional evaporators, as for example illustrated in FIG. 2, the liquid and vapour within the system travel along the same path. As such, vapour under pressure in the evaporator forces slugs of liquid through the system, ultimately ending up in the accumulator. In the evaporator 300 illustrated in FIGS. 3 and 4, a vapour circuit 320 is disposed between the first layer and second layer of the evaporator 300 and is in communication with the liquid chambers 310*a*, 310*b* and 310*c*, and is adapted to receive vapour exiting the liquid chambers 310*a*, 310*b* and 310*c*.

More specifically, the vapour circuit 320 includes a first vapour draw off channel 322*a* in communication with the first liquid overflow 316*a* of the first liquid chamber 310*a*. Vapour formed in the first liquid overflow 316*a* and the first overflow channel 318*a* disposed around the peripheral walls of the first liquid chamber 310*a* flows into the first vapour draw off channel 322*a* and into a peripheral vapour channel 324 in fluid communication with the vapour outlet 308.

A second vapour draw off channel 322*b* is in communication with the second liquid overflow 316*b* of the second liquid chamber 310*b*. Vapour formed in the second liquid overflow 316*b* and the second overflow channel 318*b* disposed around the peripheral walls of the second liquid chamber 310*b* flows into the second vapour draw off channel 322*b* and into the peripheral vapour channel 324.

A third vapour draw off channel 322*c* is in communication with the third liquid chamber 310*c*. Vapour in the third liquid chamber 310*c* flows into the third vapour draw off channel 322*c* and into the peripheral vapour channel 324. Therefore, the vapour circuit 320 comprises respective draw off vapour channels 322 to receive flow of refrigerant vapour from corresponding liquid chambers whereby the draw off vapour channels 322 are in fluid communication with peripheral vapour channels 324 disposed along peripheral regions of the evaporator 300 for reducing or preventing slugs of liquid refrigerant flowing into the vapour circuit 320. Each respective draw off vapour channel 322 is located along an in-use upper portion of the corresponding liquid chamber 310.

The overflow inlets 316*a* for each liquid chamber 310 is fluidly connected with respective overflow channels disposed along peripheral regions of corresponding liquid chambers 310. Each vapour draw off channel 322B is fluidly connected with vapour channels that are disposed radially outwardly relative to the peripheral overflow channels.

According to this design, the flow of the liquid within the evaporator 300 is not significantly impacted by the flow of vapour within the evaporator 300. Moreover, the distribution of the liquid within the evaporator is much more even as compared with conventional evaporator plates, given the inclusion of more than one accumulation area within the evaporator 300. In that regard, although three liquid chambers 310*a*, 310*b* and 310*c* are illustrated, it is considered that two liquid chambers may be appropriate in certain circumstances. Likewise, four, five, six or more liquid chambers may also be appropriate. To that end, the invention is not restricted to only three liquid chambers as illustrated.

The second liquid chamber 310*b* and third liquid chamber 310*c* include connecting portions 326 disposed within the second liquid chamber 310*b* and third liquid chamber 310*c* and extending between and connecting the first layer and the second layer of the evaporator 300. The connecting portions 326 advantageously provide improved strength to the second liquid chamber 310*b* and third liquid chamber 310*c*. While not illustrated the first liquid chamber 310*a* may also include such connecting portions 326.

As illustrated in FIG. 4, the evaporator 300 may be particularly useful in mobile or portable applications. For example, the evaporator may be particularly suited to in-vehicle environments. As illustrated, the evaporator 300 may be tipped to an angle of up to 30° or greater and still provide efficient thermal transfer.

When the evaporator 300 is tipped to such an angle, liquid within the first liquid chamber 310*a* overflows more significantly into the first liquid overflow 318*a*, but does not transfer into the first vapour draw off channel 322*a*. Likewise, liquid within the second liquid chamber 310*b* overflows more significantly into the second liquid overflow 318*b*, but does not transfer into the second vapour draw off channel 322*b*. Liquid within the third liquid chamber 310*c* is disposed more to the side to which the evaporator 300 is leaning, but not to the extent that it overflows into the third vapour draw off channel 322*c*.

As can be clearly seen particularly in FIG. 3, each liquid chamber 310 comprises a bottom wall, a top wall and side walls such that inner surfaces of the bottom wall, top wall and side walls define a substantially enclosed internal volume for accumulating the liquid refrigerant. The outer surface of the top wall for each liquid chamber 310 defines a first part of the overflow channel 322 and the side walls define a second part of the peripherally located overflow channels for each liquid chamber 310.

As shown clearly in FIG. 3, the overflow outlet 322 for each liquid chamber 310 is located to direct the overflow of the liquid refrigerant along the outer surface of the top wall of said each liquid chamber 310 defining a portion of the overflow channel to spread the overflowing liquid along the outer surface of the top wall and facilitate vapour draw off from the overflow channel into the peripherally disposed vapour channels via the vapour draw off channels 322*b*.

In addition to the liquid flow within the evaporator 300, vapour within the three liquid chambers 310*a*, 310*b* and 310*c* can escape into the first vapour draw off channel 322*a*, second vapour draw off channel 322*b* and third vapour draw off channel 322*c* respectively. Vapour within the evaporator 300 does not get blocked from exiting the vapour outlet 308 by liquid within the evaporator 300. Also, liquid within the evaporator 300 is still relatively well dispersed across the evaporator 300.

It would be understood that the refrigeration evaporator 300 may be used in combination with a compressor that is fluidly coupled to the vapour circuit 320 of the evaporator 300 for receiving and compressing vapour under high pressure; and a condenser in fluid communication with the compressor for receiving the compressed vapour from the compressor and condensing the compressed vapour to form liquid refrigerant and fluidly coupling the condenser to pass the liquid refrigerant to the liquid inlet 306.

Figure 5:
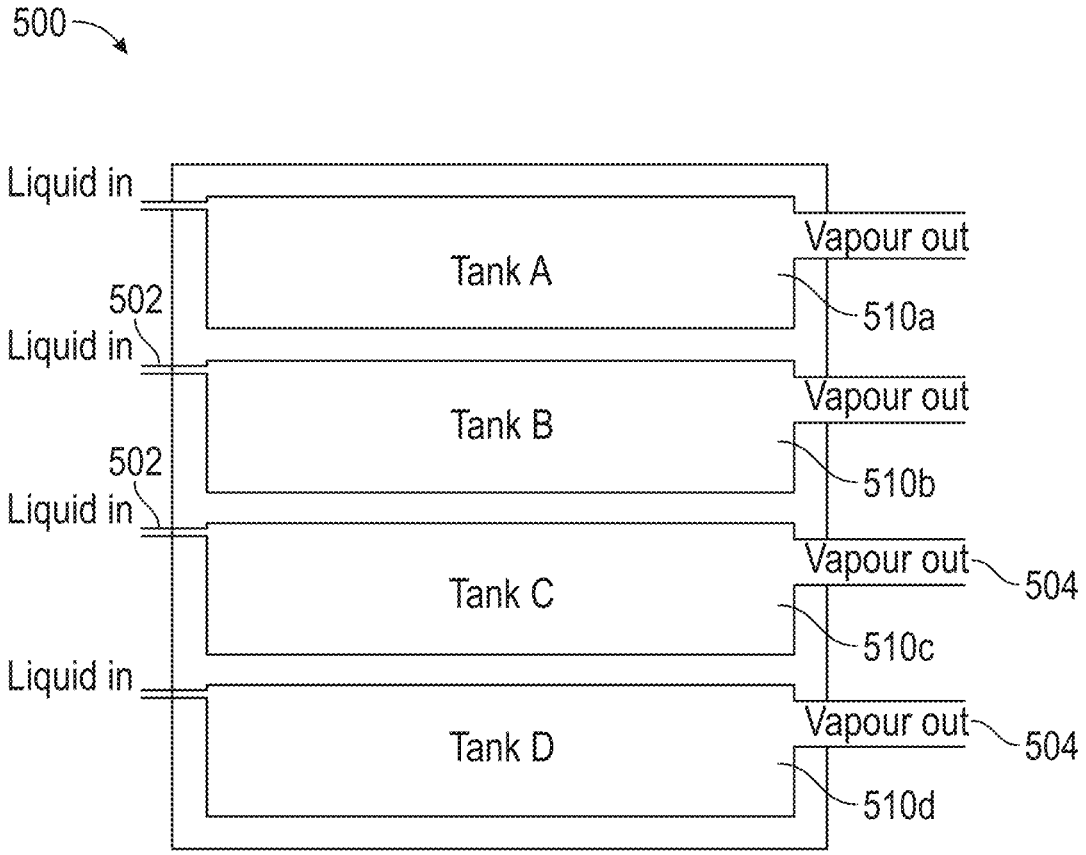
FIG. 5 illustrates a cut-away view of a thermal transfer device according to another embodiment of the invention.

Referring to FIG. 5, an alternative embodiment of the thermal transfer device 500 is illustrated. In this embodiment, a plurality of liquid chambers 510*a*, 510*b*, 510*c* and 510*d* are disposed on the thermal transfer device 500. Each of the separate liquid chambers 510*a*, 510*b*, 510*c* and 510*d* has a liquid inlet 502 for introducing liquid to a respective liquid chamber 510*a*, 510*b*, 510*c* and 510*d* and a vapour outlet 504 for removing vapour from a respective liquid chamber 510*a*, 510*b*, 510*c* and 510*d*. The contours for the plurality of liquid chambers 510*a*, 510*b*, 510*c* and 510*d*, liquid inlets 502 and vapour outlets 504 may be formed during roll bonding.

As illustrated, the liquid inlets 502 are disposed on an upper left corner of the liquid chambers 510*a*, 510*b*, 510*c* and 510*d* and the vapour outlets 504 are disposed on an upper left corner of the liquid chambers 510*a*, 510*b*, 510*c* and 510*d*. As liquid enters the liquid chambers 510*a*, 510*b*, 510*c* and 510*d* it flows into a lower portion of the liquid chamber 510*a*, 510*b*, 510*c* and 510*d* where it boils off. The vapour produced exits at the vapour outlets 504 at the upper opposing side of the liquid chambers 510*a*, 510*b*, 510*c* and 510*d*.

As the liquid is in the lower portion of the liquid chambers 510*a*, 510*b*, 510*c* and 510*d*, interaction with vapour is minimised. Moreover, the vapour within the thermal transfer device 500 does not force the liquid through the thermal transfer device 500, and the liquid does not impinge on the vapour outlets 504.

The location of the liquid chambers 510*a*, 510*b*, 510*c* and 510*d* on the thermal transfer device 500 has the added advantage of more evenly distributing the liquid across the thermal transfer device 500, as opposed to being collected in an accumulator of the device. It is noted that the illustrated vapour exits may be prone to flood back due to the rapidly expanding vapour throwing the liquid up and into the vapour outlet. The compressor suction may then disadvantageously draw the liquid out the vapour path and cause flood back. The design and area around the vapour outlet may be provided with a different design to that shown to address such issues.

Figure 6:
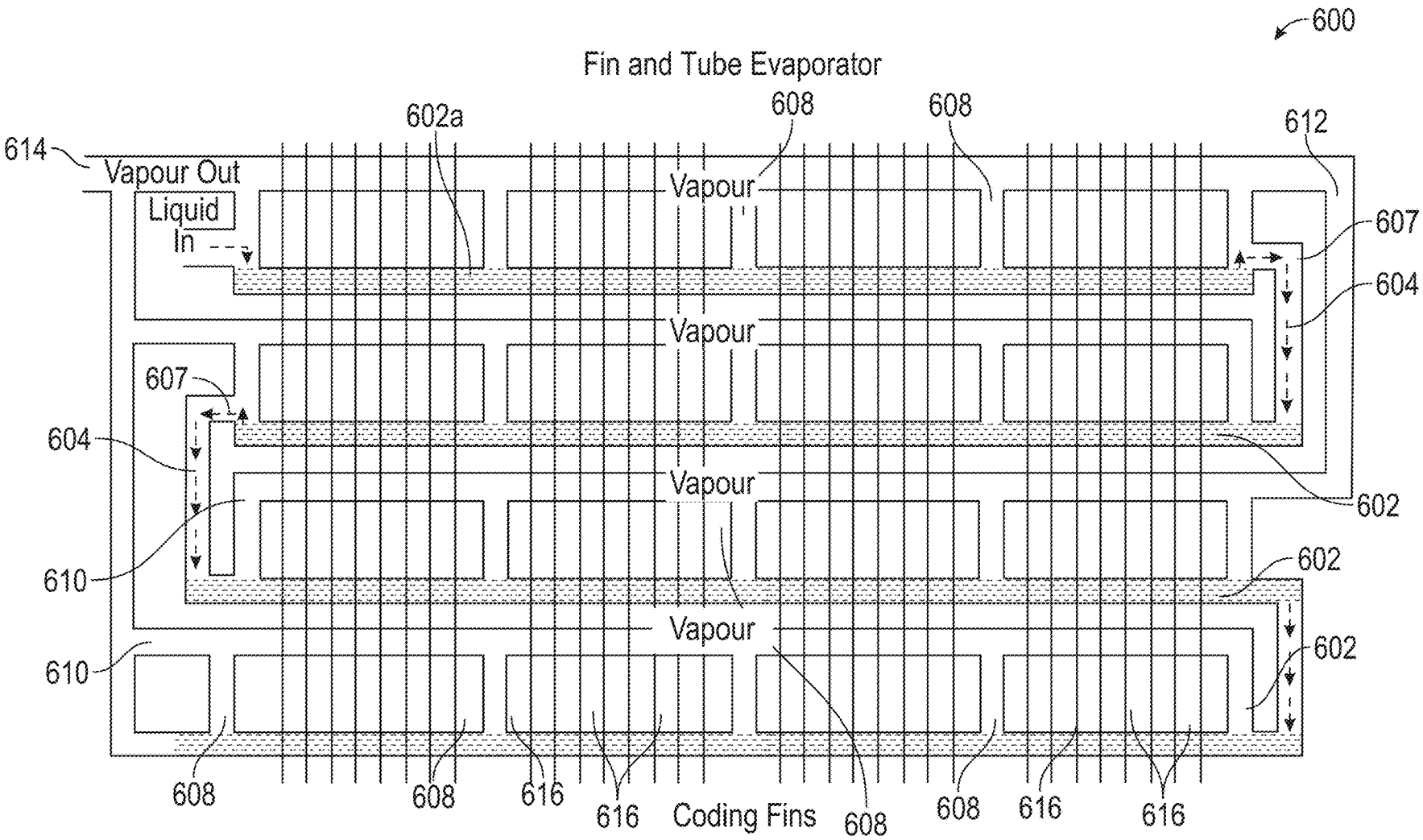
FIG. 6 illustrates a cut-away view of a thermal transfer device according to a further embodiment of the invention.

Referring to FIG. 6, a fin and tube type thermal transfer device 600 is illustrated. In this embodiment, the thermal transfer device 600 comprises a plurality of fluidly connected liquid conduits 602 that form interposed by overflow conduits 604. A liquid inlet 606 is provided for introducing liquid to a first of the liquid conduits 602*a*. The plurality of liquid conduits 602 are arranged to form a plurality of chambers that are disposed on the thermal transfer device 600 and are associated with stepped portions 607 disposed along and/or at overflow ends of one or more of the liquid conduits 602. Each of the liquid chambers formed by parts of the conduits 602 are interconnected by respective overflow inlets and outlets to allow flow of liquid refrigerant between the plurality of fluidly connected conduits under gravity such that during influent flow of the refrigerant liquid through the inlet, the liquid chambers formed by the conduit 602 accumulate the refrigerant liquid sequentially to impede the flow of the refrigerant liquid.

The stepped portions 607 are in communication with the overflow conduits 604 such that when the liquid conduits 602 are full, liquid overflows the stepped portions 607 into the overflow conduits 604 and into a subsequent liquid conduit 602.

A plurality of vapour conduits 608 are in communication with the plurality of fluidly connected liquid conduits 602 and adapted to receive vapour exiting the liquid conduits 602. A number of the vapour conduits 608 that form draw off vapour channels are disposed on an upper side and spaced along the length of each of the liquid conduits 602, thereby facilitating draw off of vapour along the length of each liquid conduit 602. These vapour draw off channels direct the vapour to peripheral vapour channels denoted by 612 that are located along peripheral regions of the evaporator 600. The liquid conduits 602 are of a diameter that will facilitate separation of the vapour to an upper region of the liquid conduits 602 where it can be drawn off into the vapour conduits 608. The vapour conduits 608 are in communication with a respective vapour circuit conduit 610 constituting part of a vapour circuit 612. The vapour circuit 612 is in communication with a vapour outlet 614 for removing vapour from the vapour circuit 612.

The thermal transfer device 600 further comprises a plurality of fins 616 associated with the plurality of liquid conduits 602. The fins 616 advantageously increase the surface area available for thermal transfer.

It would be understood that the refrigeration evaporator 600 may be used in combination with a compressor that is fluidly coupled to the vapour circuit 612 of the evaporator 600 for receiving and compressing vapour under high pressure; and a condenser in fluid communication with the compressor for receiving the compressed vapour from the compressor and condensing the compressed vapour to form liquid refrigerant and fluidly coupling the condenser to pass the liquid refrigerant to the liquid inlet 606.

Figure 7:
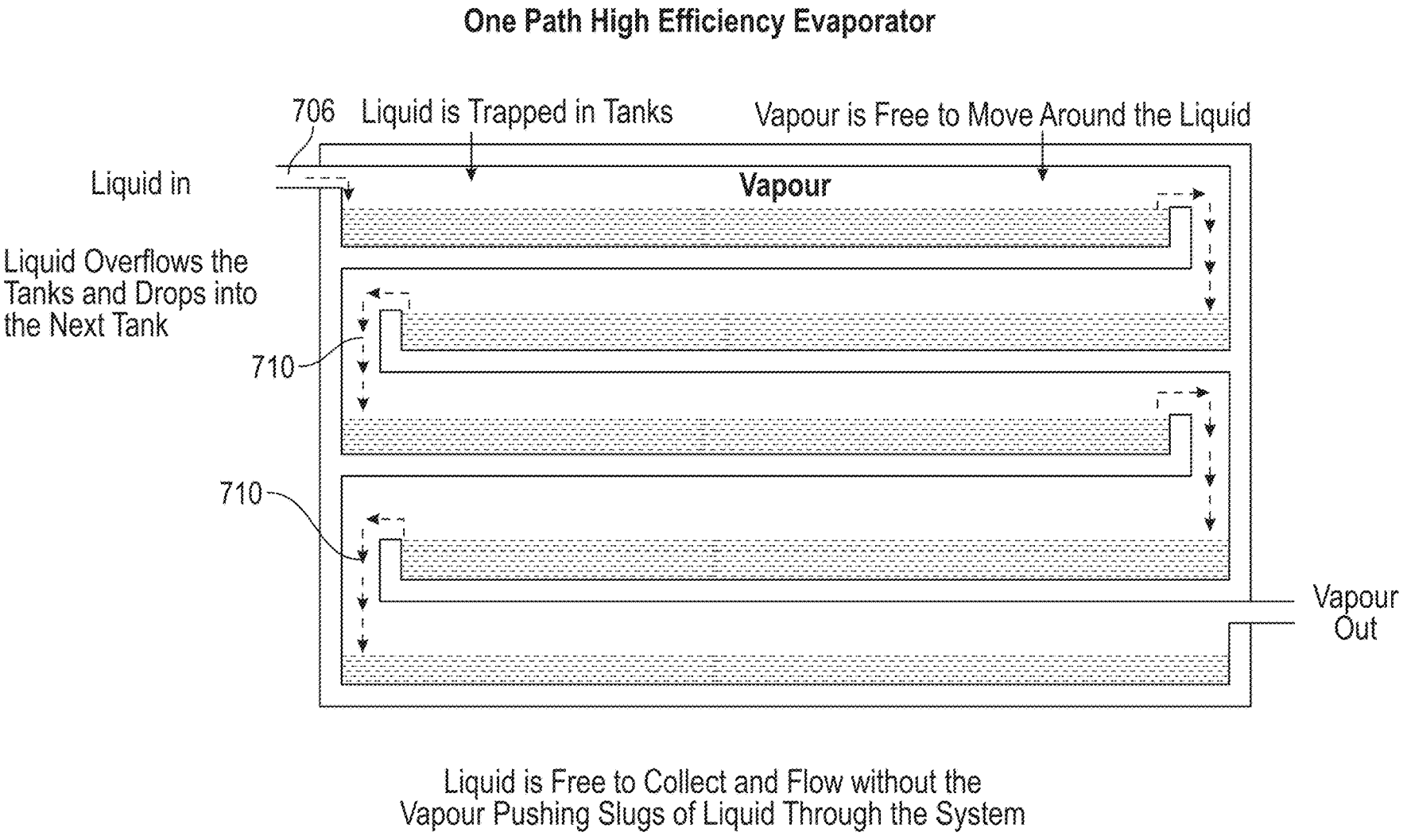
FIG. 7 illustrates a cut-away view of a thermal transfer device according to a further embodiment of the invention.

Turning to FIG. 7, a thermal transfer device 700 is illustrated that includes a plurality of vapour by-pass areas 702, as opposed to a separate vapour circuit as previously illustrated. In this embodiment, the vapour by-pass areas 702 effectively form a vapour circuit.

The thermal transfer device 700 includes a plurality of interconnected liquid collectors 704 and a plurality of liquid inlets 706 for introducing liquid to the liquid collectors 704 and a plurality of vapour outlets 708 for removing vapour from the thermal transfer device 700. Once again, each of the liquid collectors 704 are interconnected by overflow channels or portions 710 to allow flow of liquid refrigerant between the plurality of fluidly connected liquid chambers under gravity such during influent flow of the refrigerant liquid the liquid chambers accumulate the refrigerant liquid sequentially to impede the flow of the refrigerant liquid.

Each of the liquid collectors 704 are fluidly connected to one another by the overflow portion 710. The overflow portions 710 are disposed on consecutive liquid collectors 704. As will be appreciated from the illustration, the overflow portions 710 are also of a diameter that will facilitate flow of vapour without significant interaction with liquid within the thermal transfer device 700. As a result, the vapour circuit comprising vapour flow paths is disposed within the overflow portions 710. The overflow inlets for each liquid collector 704 is fluidly connected with the respective overflow channels 710 disposed along peripheral regions of corresponding liquid collectors 704.

Each liquid collector 704 comprises a bottom wall, a top wall and side walls such that inner surfaces of the bottom wall, top wall and side walls define a substantially enclosed internal volume for accumulating the liquid refrigerant. The overflow outlet 710 for each collector 704 comprises a stepped portion along a side wall that is sufficiently spaced away from the top wall to facilitate flow of vapour along the vapour flow paths in an upper portion of the liquid chamber, the upper portion being at or adjacent the top wall of the liquid chamber for reducing significant interaction between the vapour and the liquid refrigerant during use.

Importantly, each overflow channel 710 comprises a sufficiently large cross-section to facilitate flow of vapour along the vapour flow paths therein to allow the liquid to collect and flow without the vapour pushing slugs of the liquid through the cross-section without blocking the flow of the liquid.

Figure 8:
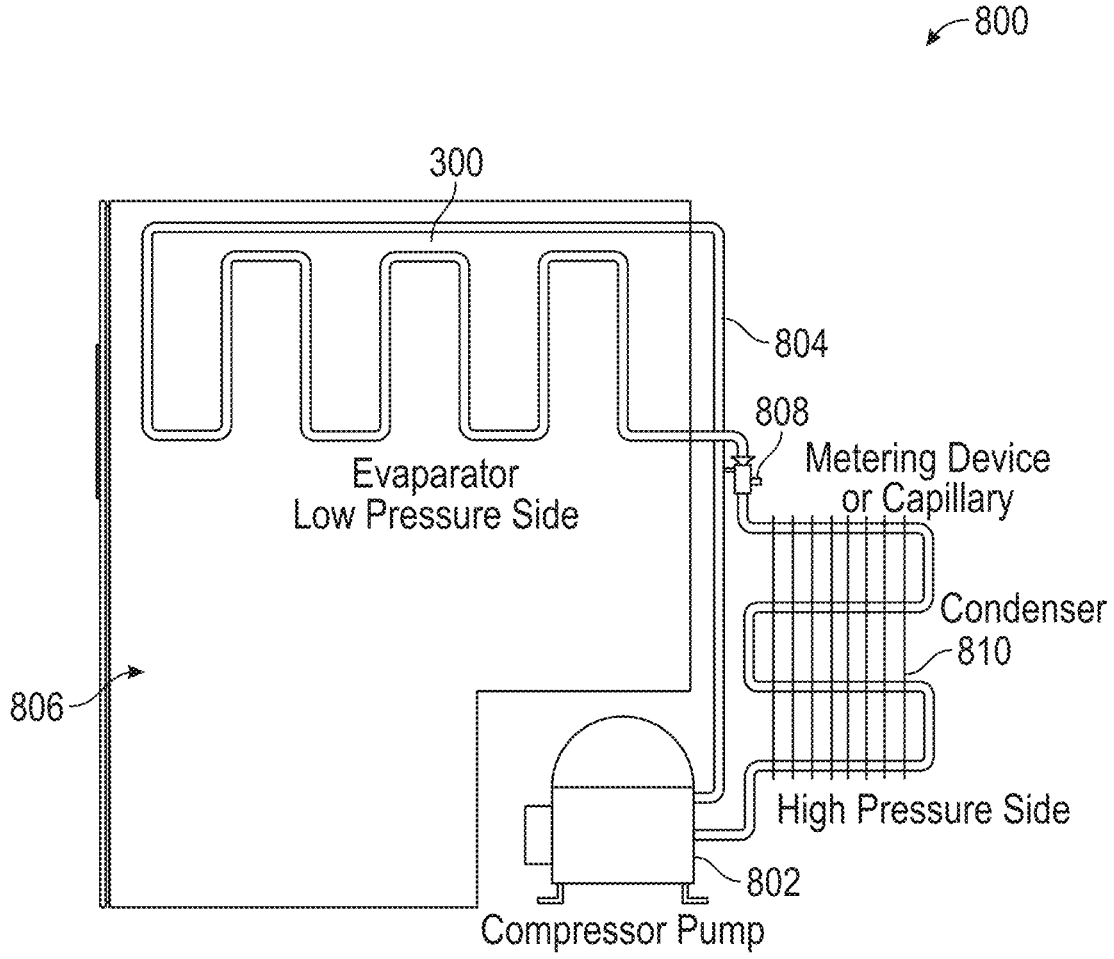
FIG. 8 illustrates a storage system according to one embodiment of the invention
Figure 9:
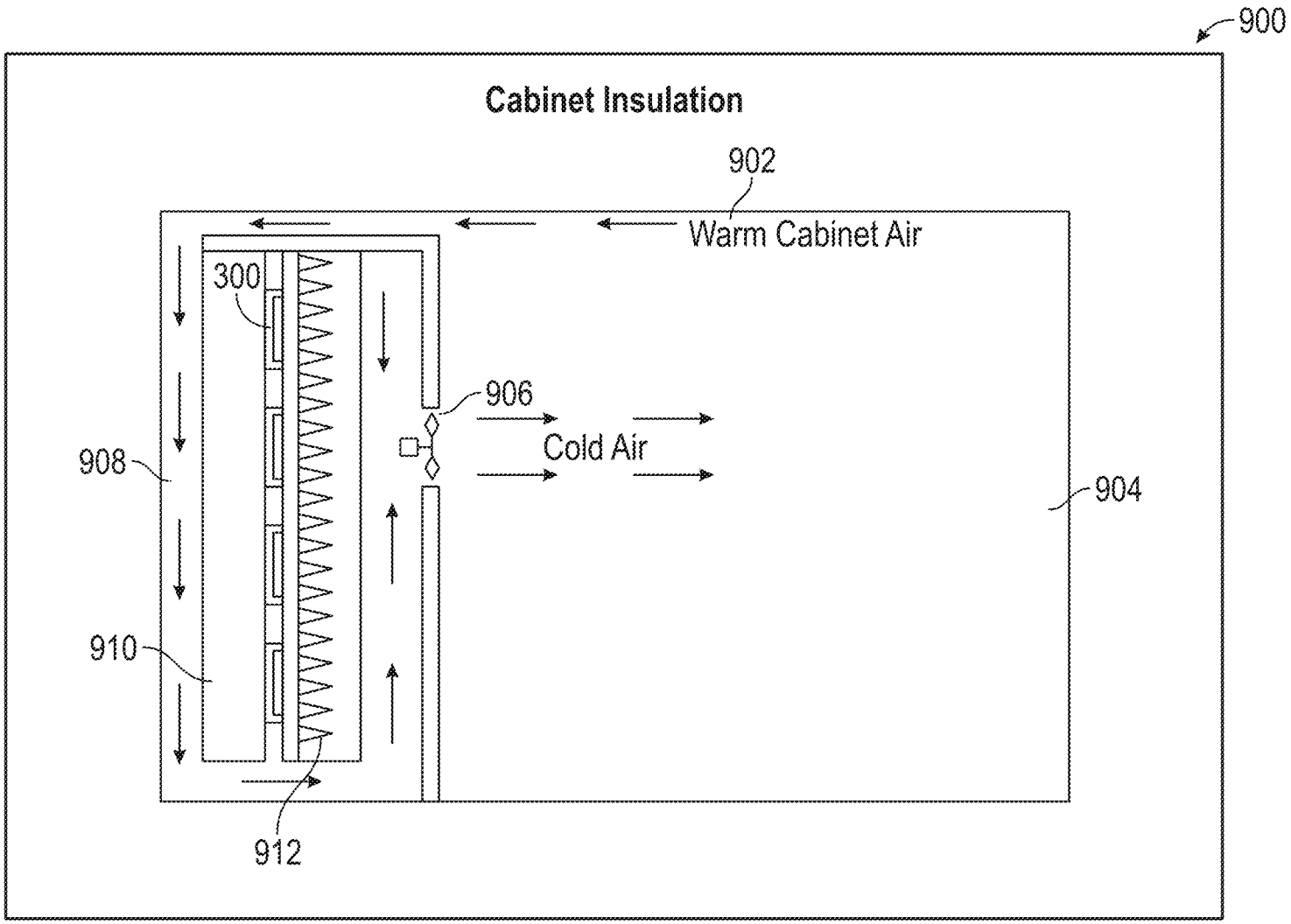
FIG. 9 illustrates an insulated storage cabinet design incorporating a thermal storage device.
Figure 10:
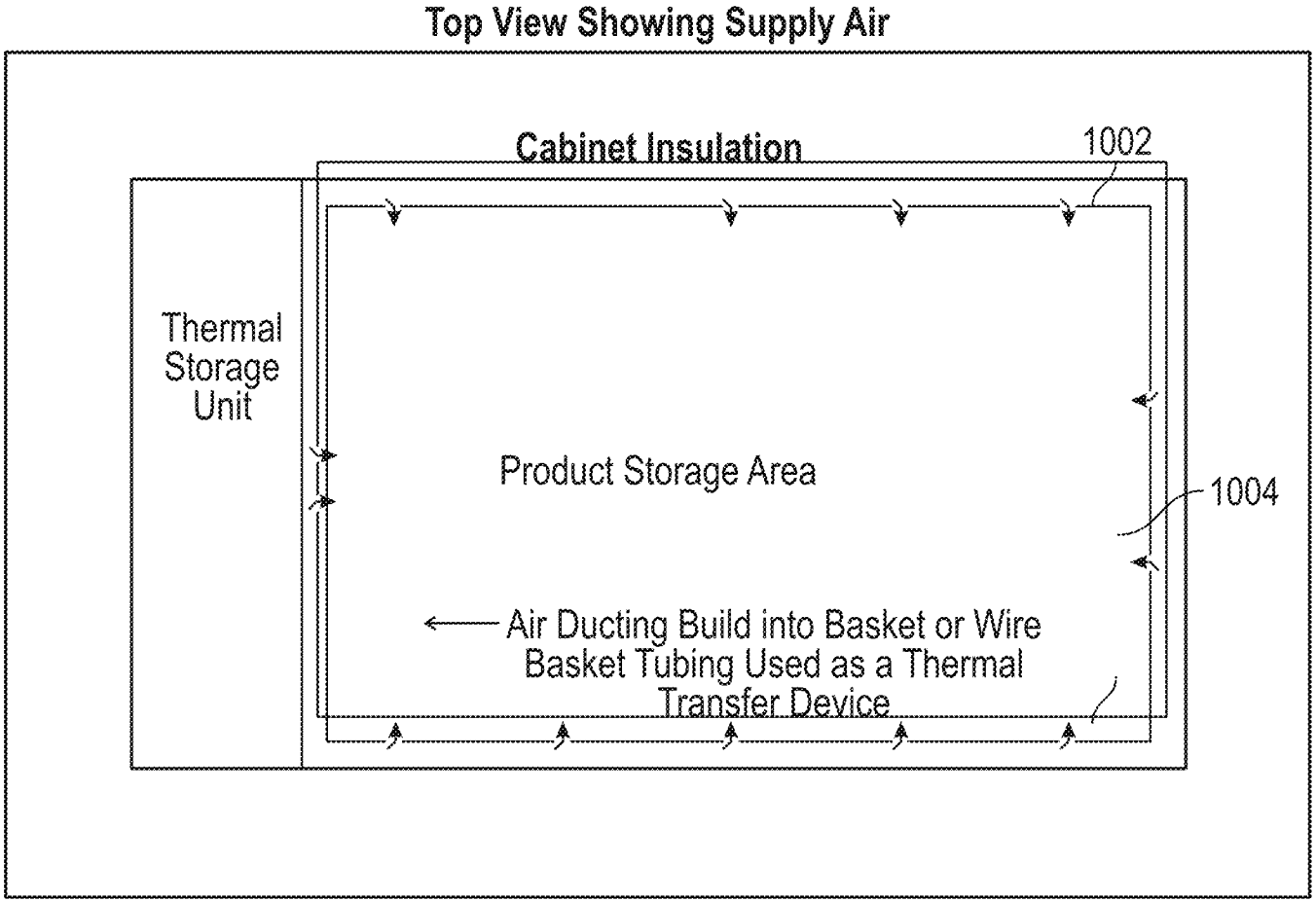
FIG. 10 illustrates an alternative insulated storage cabinet design incorporating a thermal storage device.

Referring to FIG. 8, a storage system 800 is illustrated. The storage system includes a compressor 802 that is in fluid communication with a thermal transfer device, in the form of an evaporator 300 as previously described, via conduit 804. The evaporator 300 is contained within or forms the lining of an inner wall of an insulated storage compartment 806. The conduit 804 is in fluid communication with the liquid inlet to the evaporator 300 (previously discussed).

Vapour in the compressor 802 is compressed and is discharged from the compressor 802 as hot high pressure vapour and pushed to a condenser 810. The hot high pressure vapour is then cooled and condenses to liquid. The liquid is then fed through a metering device or capillary 808. As the liquid passes through the metering device or capillary 808 the pressure drops and it enters the evaporator 300. The low pressure liquid then boils off to vapour as it absorbs the thermal energy from the cabinet. The vapour is then drawn back to the compressor 802.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A refrigeration evaporator for use in refrigeration systems, the refrigeration evaporator comprising:

a plurality of fluidly connected liquid chambers disposed between first and second layers of material, an inlet for receiving and introducing liquid refrigerant into at least one of said plurality of liquid chambers; and wherein each of the liquid chambers are interconnected by respective overflow inlets and outlets to allow flow of liquid refrigerant between the plurality of fluidly connected liquid chambers under gravity such during influent flow of the refrigerant liquid through the inlet, the liquid chambers accumulate the refrigerant liquid sequentially to impede the flow of the refrigerant liquid;

a vapor circuit comprising respective draw off vapor channels being provided to receive flow of refrigerant vapor from corresponding liquid chambers, the draw off vapor channels being in fluid communication with peripheral vapor channels disposed along peripheral regions of the refrigeration evaporator for reducing or preventing slugs of liquid refrigerant flowing into the vapor circuit wherein the vapor circuit and the overflow inlets and outlets are disposed between the first and second layers of material; and wherein the overflow inlets for each liquid chamber is fluidly connected with respective overflow channels disposed along peripheral regions of corresponding liquid chambers and wherein the vapor channels are disposed radially outwardly relative to the overflow channels.

2. The refrigeration evaporator in accordance with claim 1 wherein each respective vapor channel is located along an in-use upper portion of the corresponding liquid chamber.

3. A The refrigeration evaporator in accordance with claim 1 wherein each liquid chamber comprises a bottom wall, a top wall and side walls such that inner surfaces of the bottom wall, top wall and side walls define a substantially enclosed internal volume for accumulating the liquid refrigerant such and wherein outer surfaces of one or more of the top wall, side wall and bottom wall define at least a portion of the overflow channels.

4. The refrigeration evaporator in accordance with claim 3 wherein the overflow outlet for each liquid chamber is located to direct the overflow of the liquid refrigerant along the outer surface of the top wall of said each liquid chamber defining a portion of the overflow channel to spread the overflowing liquid along the outer surface of the top wall and facilitate vapor draw off from the overflow channel into the peripherally disposed vapor channels.

5. A The refrigeration evaporator in accordance with claim 1 wherein each liquid chamber is surround by an outer peripheral walls such that an inner surface of the outer peripheral walls define a portion of the overflow channel and an outer surface of the peripheral walls defines a portion of the vapor channels.

6. The refrigeration evaporator in accordance with claim 1 wherein in an in-use configuration each of the liquid chambers are positioned at different relative heights to allow flow of liquid refrigerant between the plurality of fluidly connected liquid chambers under gravity.

7. The refrigeration evaporator in accordance with claim 1 further comprising a vapor outlet being fluidly coupled with the vapor circuit to allow coupling of a compressor with the vapor circuit for allowing the compressor, when fluidly connected to the vapor outlet, to receive and compress vapor under high pressure during use.

8. The refrigeration evaporator in accordance with claim 1 wherein the plurality of liquid chambers, the vapor circuit and the overflow inlets and outlets are disposed between the first and second layers of roll bonded metal.

9. A refrigeration system comprising:

a refrigeration evaporator in accordance with claim 1, a compressor being fluidly coupled to the vapor circuit of the refrigeration evaporator for receiving and compressing vapor under high pressure; and a condenser in fluid communication with the compressor for receiving compressed vapor from the compressor and condensing the compressed vapor to form liquid refrigerant and fluidly coupling the condenser to pass the liquid refrigerant to the inlet.

10. A refrigeration evaporator for use in refrigeration systems, the refrigeration evaporator comprising:

a plurality of fluidly connected liquid chambers, an inlet for receiving and introducing liquid refrigerant into at least one of said plurality of liquid chambers; and wherein each of the liquid chambers are interconnected by respective overflow inlets and outlets to allow flow of liquid refrigerant between the plurality of fluidly connected liquid chambers under gravity such that during influent flow of the refrigerant liquid through the inlet, the liquid chambers accumulate the refrigerant liquid sequentially to impede the flow of the refrigerant liquid;

a vapor circuit comprising vapor conduits comprising respective draw off vapor channels being provided to receive flow of refrigerant vapor from corresponding liquid chambers, the draw off vapor channels being in fluid communication with peripheral vapor channels disposed along peripheral regions of the refrigeration evaporator for reducing or preventing slugs of liquid refrigerant flowing into the vapor circuit, wherein the overflow inlets for each liquid chamber is fluidly connected with respective overflow channels disposed along peripheral regions of corresponding liquid chambers and wherein the vapor channels are disposed radially outwardly relative to the overflow channels.

11. The refrigeration evaporator in accordance with claim 10 wherein each respective vapor channel is located along an in-use upper portion of the corresponding liquid chamber.

12. A The refrigeration evaporator in accordance with claim 10 wherein each liquid chamber comprises a bottom wall, a top wall and side walls such that inner surfaces of the bottom wall, top wall and side walls define a substantially enclosed internal volume for accumulating the liquid refrigerant such and wherein outer surfaces of one or more of the top wall, side wall and bottom wall define at least a portion of the overflow channels.

13. The refrigeration evaporator in accordance with claim 12 wherein the overflow outlet for each liquid chamber is located to direct the overflow of the liquid refrigerant along a stepped portion of each liquid chamber, the stepped portion defining a portion of the overflow channel to spread the overflowing liquid along the outer surface of the stepped portion and facilitate vapor draw off from the overflow channel into the peripherally disposed vapor channels.

14. The refrigeration evaporator in accordance with claim 10 wherein each liquid chamber is surround by an outer peripheral walls such that an inner surface of the outer peripheral walls define a portion of the overflow channel and an outer surface of the peripheral walls defines a portion of the vapor channels.

15. The refrigeration evaporator in accordance with claim 10 wherein in an in-use configuration each of the liquid chambers are positioned at different relative heights to allow flow of liquid refrigerant between the plurality of fluidly connected liquid chambers under gravity.

16. The refrigeration evaporator in accordance with claim 10 further comprising a vapor outlet being fluidly coupled with the vapor circuit to allow coupling of a compressor with the vapor circuit for allowing the compressor, when fluidly connected to the vapor outlet, to receive and compress vapor under high pressure during use.

17. The refrigeration evaporator in accordance with claim 10 further comprising a plurality of fins associated with the conduits forming the vapor circuit.

18. A refrigeration system comprising:

a refrigeration evaporator in accordance with claim 10, a compressor being fluidly coupled to the vapor circuit of the refrigeration evaporator for receiving and compressing vapor under high pressure; and a condenser in fluid communication with the compressor for receiving compressed vapor from the compressor and condensing the compressed vapor to form liquid refrigerant and fluidly coupling the condenser to pass the liquid refrigerant to the inlet.

* * * * *